US007775511B2

(12) United States Patent
Lee

(10) Patent No.: US 7,775,511 B2
(45) Date of Patent: Aug. 17, 2010

(54) STITCHING DEVICE AND METHOD FOR STITCHING PRINTED PRODUCTS

(75) Inventor: Joel Winn Lee, Rochester, NH (US)

(73) Assignee: Goss International Americas, Inc., Durham, NH (US)

( * ) Notice: Subject to any disclaimer, the term of this patent is extended or adjusted under 35 U.S.C. 154(b) by 567 days.

(21) Appl. No.: 11/148,807

(22) Filed: Jun. 9, 2005

(65) Prior Publication Data

US 2005/0285319 A1 Dec. 29, 2005

Related U.S. Application Data

(60) Provisional application No. 60/583,780, filed on Jun. 29, 2004.

(51) Int. Cl.
*B65H 37/04* (2006.01)

(52) U.S. Cl. ..... 270/52.18; 270/52.14; 270/52.16; 270/52.26; 270/52.29

(58) Field of Classification Search ..... 270/52.14, 270/52.16, 52.18, 52.26, 52.29, 58.01, 58.08, 270/58.29; 198/699.1, 728, 734
See application file for complete search history.

(56) References Cited

U.S. PATENT DOCUMENTS

| | | | | |
|---|---|---|---|---|
| 3,630,513 | A * | 12/1971 | Davidson et al. | 270/52.04 |
| 3,807,547 | A * | 4/1974 | Mueller | 198/644 |
| 4,134,579 | A * | 1/1979 | Polarek et al. | 270/52.24 |
| 4,236,706 | A * | 12/1980 | Schlough | 270/52.18 |
| 4,295,643 | A * | 10/1981 | de la Vega | 270/52.19 |
| 4,506,873 | A * | 3/1985 | Faltin | 270/46 |
| 4,519,599 | A * | 5/1985 | Mayer | 270/52.18 |
| 4,641,824 | A * | 2/1987 | Wallgren et al. | 270/30.06 |
| 5,411,250 | A | 5/1995 | Belec et al. | 271/185 |
| 5,678,813 | A * | 10/1997 | Osako et al. | 270/52.16 |
| 6,213,457 | B1 | 4/2001 | Schlough | |
| 6,237,746 | B1 * | 5/2001 | Sussmeier | 198/732 |
| 6,612,559 | B2 * | 9/2003 | Boss | 270/52.18 |
| 6,769,676 | B2 | 8/2004 | Machon et al. | |
| 2002/0101019 | A1 * | 8/2002 | Boss | 270/58.08 |
| 2004/0099505 | A1 * | 5/2004 | Robinson et al. | 198/485.1 |

FOREIGN PATENT DOCUMENTS

| | | |
|---|---|---|
| DE | 43 09 888 A1 | 9/1994 |
| JP | 9-156250 | 6/1997 |
| JP | 10-250257 | 9/1998 |
| JP | 2000-211752 A | 8/2000 |
| JP | 2002-192854 A | 7/2002 |

OTHER PUBLICATIONS

Timing belt—Wikipedia, the free encyclopedia; http://en.wikipedia.org/wiki/Timing_belt.*

* cited by examiner

*Primary Examiner*—Gene Crawford
*Assistant Examiner*—Leslie A Nicholson, III
(74) *Attorney, Agent, or Firm*—Davidson, Davidson & Kappel, LLC

(57) ABSTRACT

According to a first exemplary embodiment of the present invention, a stitching device comprises a stitcher and a conveyor for moving unbound printed products past the stitcher for stitching. According to a feature of the present invention, the conveyor includes a timing belt having a plurality of pushing elements for engaging and moving the unbound printed products past the stitcher.

23 Claims, 10 Drawing Sheets

Stitcher
A
Delivery
B
20
20
130
13
12
12
20
110
112
114
116
118
100
102
104
106
108
246
248
250
252
254
256
258
260
262
264
266
268
270
272
274
276
278
280
282
284
286
288
290
292
294
296
298
300
302
304
306
308
310
312
314
316
318
320
322
324

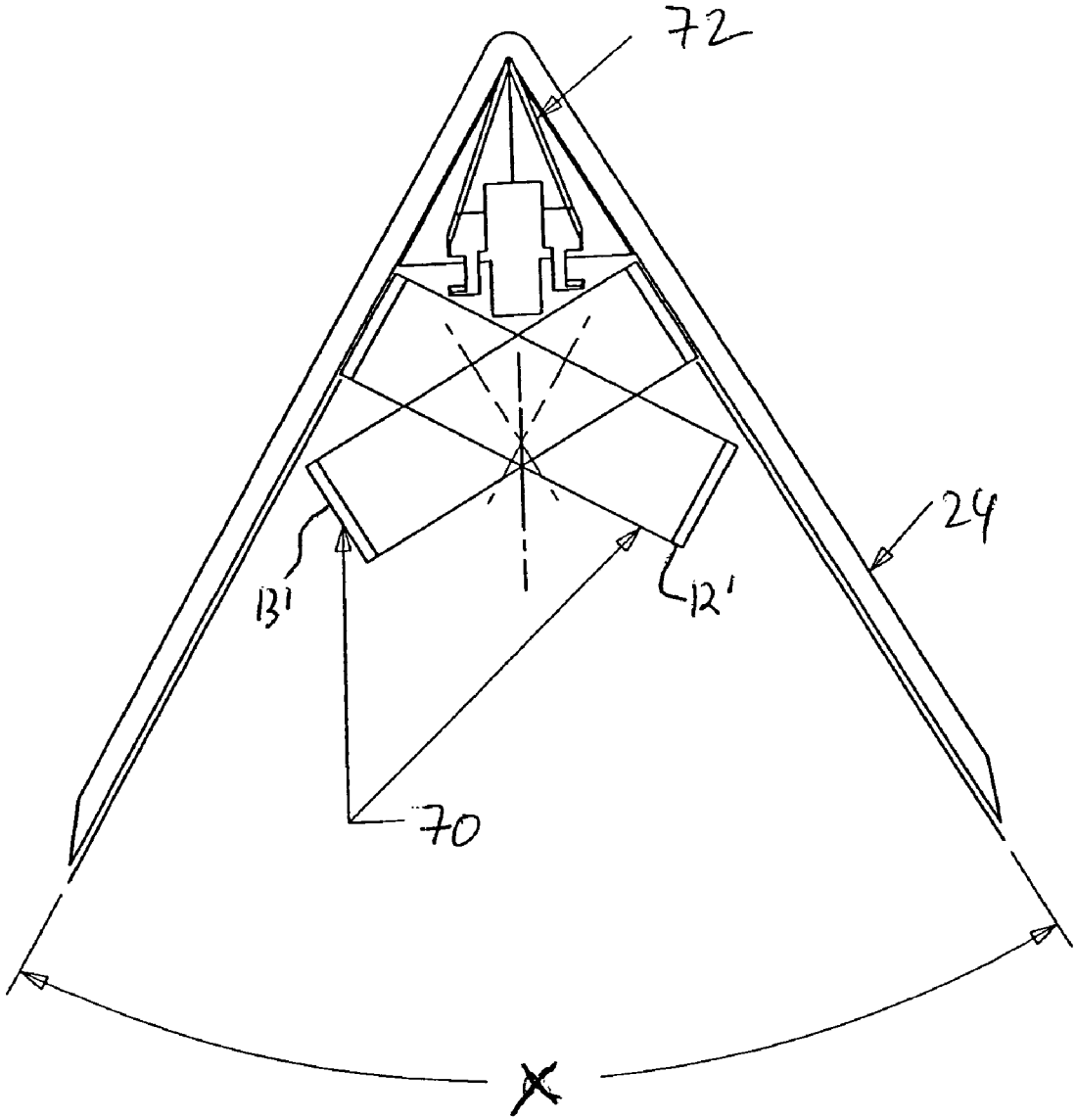
FIG. 16
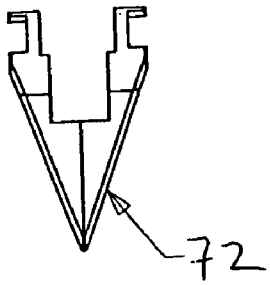

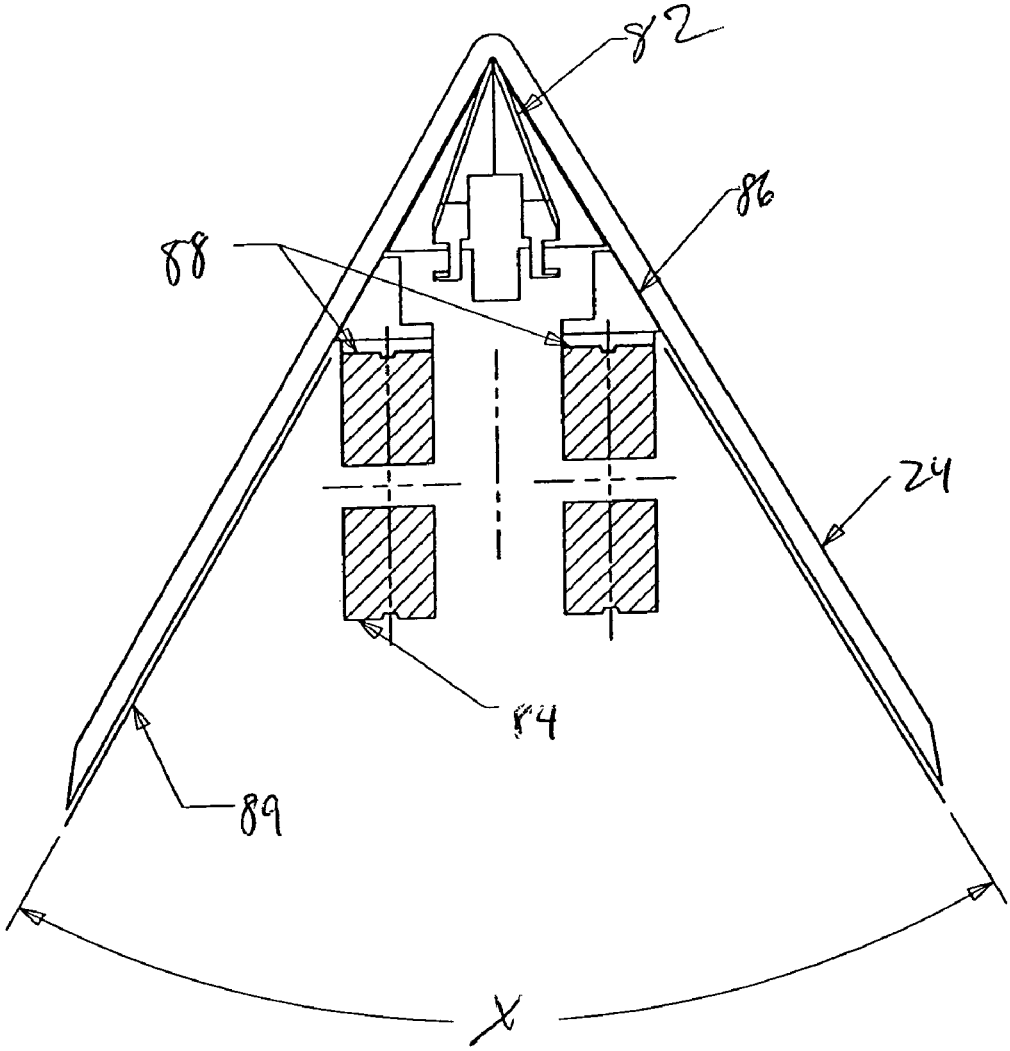
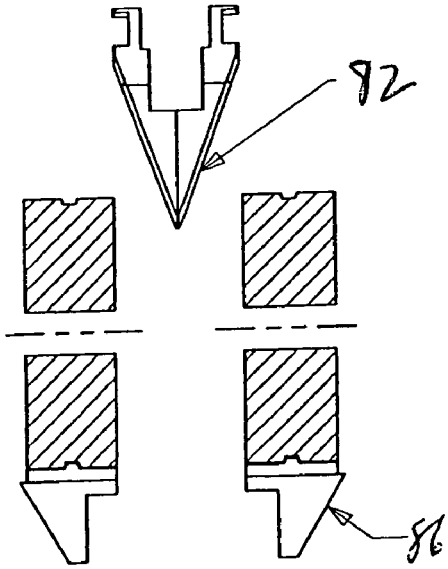
FIG. 17

STITCHING DEVICE AND METHOD FOR STITCHING PRINTED PRODUCTS

This claims the benefit of U.S. Provisional Patent Application No. 60/583,780, filed Jun. 29, 2004, which is hereby incorporated herein.

BACKGROUND OF THE INVENTION

The present invention is directed to a stitching device and a method for stitching printed products.

In the manufacture of printed products, such as books, there are many separate operations required to print, assemble and bind the final products. These operations often include a stitching operation to stitch loose, unbound books into finished, bound books. Typically, unbound books are transported at registered positions on chains of a saddle-back conveyor within a stitcher. The saddle-back conveyor transports the loose, unbound books past a stitching device that operates to stitch the unbound books into finished products. Examples of known stitching devices that utilize chains for transport of unbound, printed products, as just described, include the SP-1000 and ST-400 models manufactured by Heidelberger Druckinaschinen AG.

The use of chains for transferring unbound, printed products, however, generally involves a relatively high maintenance and costly operation. For example, the chains require lubrication, which involves not only the efforts of personnel to perform the steps needed to lubricate the chains, but also the time and effort to monitor the operation of the saddle-back conveyor to determine when lubrication is necessary. In addition, the use of chains results in high noise levels during operation of the stitcher. Moreover, it is difficult to maintain an even stretch tension in the chain for proper and efficient operation.

Thus, it would be advantageous to provide a stitcher having conveyor equipment that replaced the chains of a saddle-back conveyor so as to reduce the disadvantages associated with chain transports for unbound, printed products in a stitcher.

SUMMARY OF THE INVENTION

According to a first exemplary embodiment of the present invention, a stitching device comprises a stitcher and a conveyor for moving unbound printed products past the stitcher for stitching. According to a feature of the present invention, the conveyor includes a timing belt having a plurality of pushing elements for engaging and moving the unbound printed products past the stitcher.

According to a second embodiment of the present invention, a stitching device comprises a stitcher and a conveyor for moving unbound printed products past the stitcher for stitching. In accordance with the second embodiment of the present invention, the conveyor comprises a saddle-back conveyor including a pair of timing belts, each having a plurality of pushing elements for engaging and moving the unbound printed products past the stitcher and a wedge anvil forming a path past the stitcher for support of the unbound printed products. The wedge anvil is arranged and configured relative to the timing belts to form the saddle-back conveyor.

According to a third embodiment of the present invention, a method for stitching unbound printed products is provided. The method includes the steps of providing a stitcher and transporting unbound printed products past the stitcher for stitching by using pushing elements attached to a timing belt, and engaging the unbound printed products.

BRIEF DESCRIPTION OF THE DRAWINGS

FIGS. 16 and 17 show schematic representations of additional embodiments for the timing belts of the present invention.

DETAILED DESCRIPTION OF THE PREFERRED EMBODIMENTS

Figure 1:
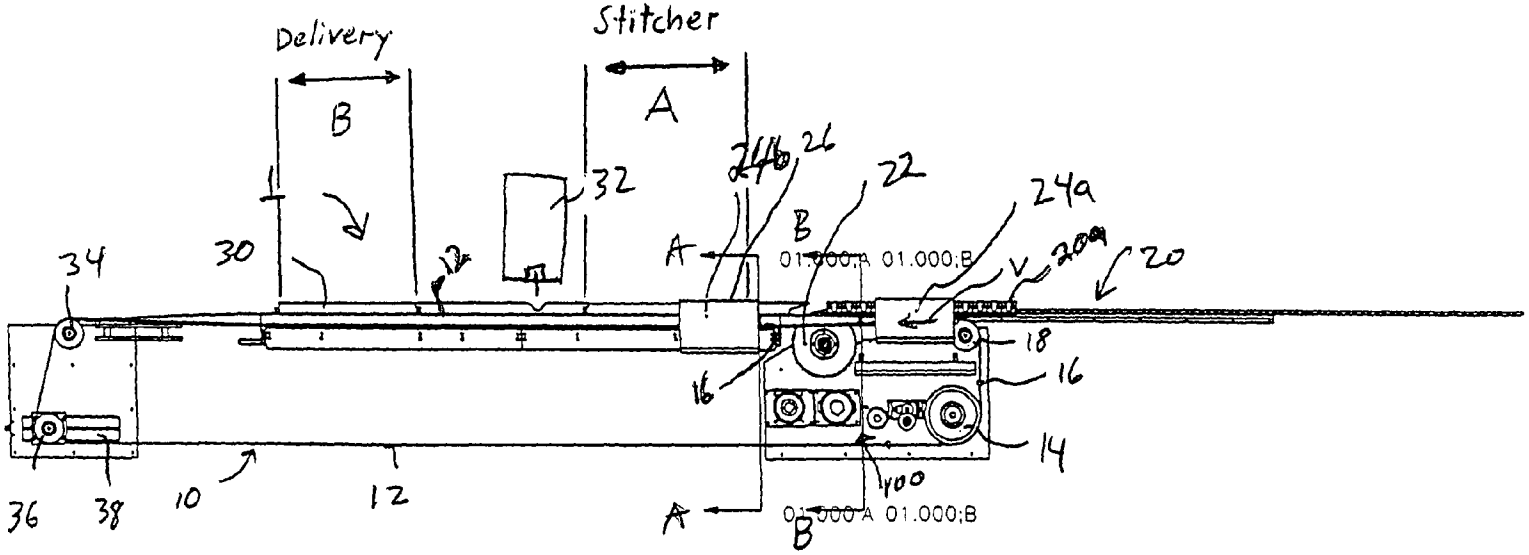
FIG. 1 shows a side view of a stitching device according to an exemplary embodiment of the present invention.

Referring now to the drawings, and initially to FIG. 1, there is shown a side view of a stitching device 1, according to an exemplary embodiment of the present invention. An inserter chain 20 is received around a toothed wheel 22 for movement toward and rotation with the wheel 22 (the return of the chain 20 from the wheel 22 is shown in phantom in FIG. 4). The inserter chain 20 is provided with saddle-back carrier elements 20*a* to support and carry an unbound, unstitched book 24*a* in direction V, as the wheel 22 rotates to cause movement of the chain 20.

A saddle-back conveyor 10 includes a stationary wedge anvil 30. The saddle-back conveyor 10 is arranged adjacent to the wheel 22, and extends longitudinally away from the wheel 22 such that the wedge anvil 30 of the conveyor 10 forms a continuation of the path defined by the section of chain 20 approaching the wheel 22. In this manner, the book 24*a* carried by the carrier element 20*a* is delivered to and received over the wedge anvil 30 as the chain 20 rotates about the wheel 24. A second book 24*b* is shown as received upon the wedge anvil 30. A stitcher 32 is arranged above the wedge anvil 30 to engage and stitch the books 24 as they move along the path, as will be described in further detail below.

According to a feature of the exemplary embodiment of the present invention illustrated in FIG. 1, a continuous timing belt 12 is extended for movement about pulleys 14, 18, 34, 36. The pulleys 14, 18, 34, 36 are arranged and configured such that the belt 12 passes along the side of the chain 20, approximate the wheel 22, and continues along a side of, but below, the wedge anvil 30, to form with the wedge anvil 30, the saddle-back conveyor 10. Moreover, the pulley 36 is slidably mounted in a slot 38, and can be moved to and fastened at a selected position along the length of the slot 38 to adjust the tension on the timing belt 12. Preferably, the belt 12 is made from a strip of plastic material, such as polyurethane. In the illustrated embodiment, the pulley 14 is arranged to drive movement of the belt 12, as will appear.

A plurality of pushing elements 16 is spaced along the length of the belt 12, with each pushing element 16 being a preselected distance from a next pushing element 16 along the belt 12. The pushing elements 16 are each arranged to engage and push a book 24 carried by a carrier element 20*a* of the chain 20, as the belt 12 is moved by the wheel 22. Moreover, the spacing between the pushing elements 16 is arranged for proper registration of the books 24 as they are moved along the path past the stitcher 32. Operation of each of the chain 20 and drive pulley 14 is coordinated and controlled by a drive mechanism 100 such that a book 24 carried by the carrier element 20*a,* is engaged by a pushing element 16 of the moving belt 12 in the vicinity of the wheel 22 and as the book 24 approaches the wedge anvil 30. The book 24 is thereafter received upon the wedge anvil 30 due to movement of the respective pushing element 16 with the belt 12, and moved by the pushing element 16 along the length of the wedge anvil 30. The length of the wedge anvil 30 includes a stitcher portion A, and a delivery portion B.

Figure 2:
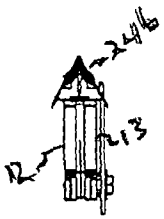
FIG. 2 is a cross-sectional view of the device of FIG. 1, taken along line A-A of FIG. 1.
Figure 3:
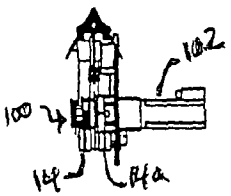
FIG. 3 is a cross-sectional view of the device of FIG. 1, taken along line B-B of FIG. 1.
Figure 4:
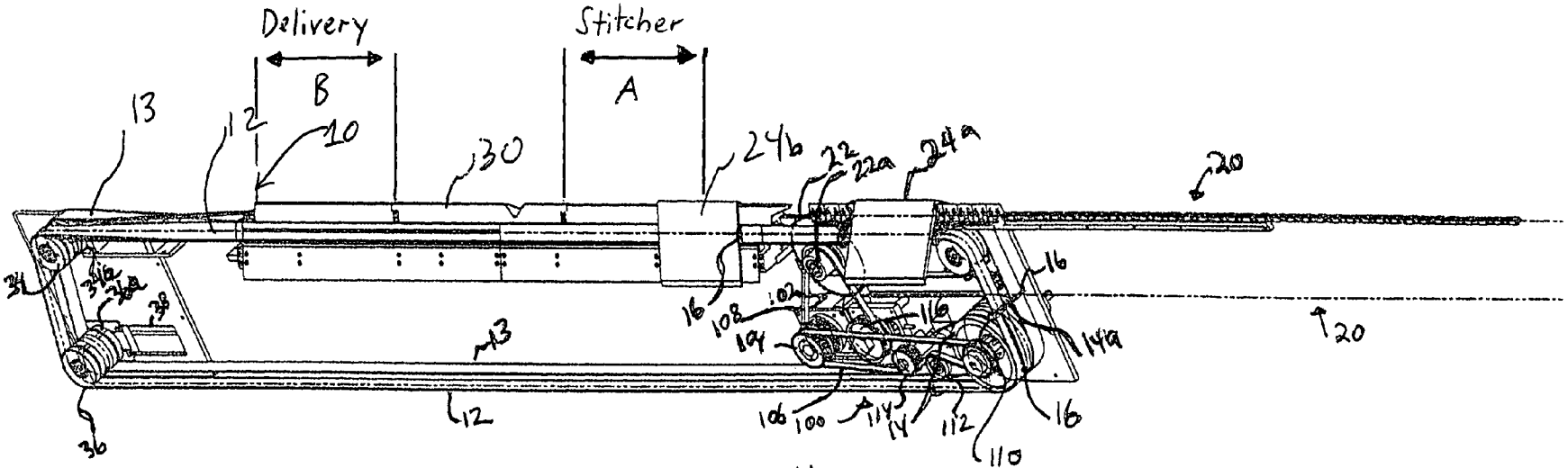
FIG. 4 shows a perspective view of the conveyor of the device of FIG. 1, according to the exemplary embodiment of the present invention.

Referring now to FIGS. 2-4, and particularly to the perspective view of FIG. 4, a second continuous timing belt 13, also including a plurality of spaced, pushing elements 16, is arranged adjacent to the timing belt 12, and extends in a similar manner as the belt 12 along the side of the chain 20 and wedge anvil 30 that is opposite from the side traversed by the belt 12. To that end, pulleys 14*a,* 18*a,* 34*a* and 36*a* are mounted in a coaxial relation to the pulleys 14, 18, 34, 36, to support the belt 13 for movement along the wedge anvil 30 on the side opposite to the belt 12. The pushing elements 16 of the belt 13 are each aligned with a corresponding pushing element 16 of the belt 12, such that the pushing elements 16 of both belts 12, 13 simultaneously engage a book 24 in the vicinity of the wheel 22, for movement along the wedge anvil 30 and past the stitcher 32.

As shown in FIGS. 3 and 4, the drive mechanism 100 comprises a drive motor 102 (see FIG. 3), including a rotating drive pulley 104. Operation of the drive motor 102 causes rotation of the drive pulley 104. A series of continuous drive belts 106, 108 are extended around the drive pulley 104 to engage and drive the pulleys 14, 14*a* and the wheel 22, respectively. The drive belt 106 wraps around a pulley 110 that is mounted in a coaxial driving relation to the coaxial pulleys 14, 14*a* for rotation of the pulleys 14, 14*a*. Operation of the drive motor 102 rotates the drive pulley 104 to cause movement of the drive belt 106 for corresponding movement of the timing belts 12, 13. In the course of extension of the drive belt 106, the belt 106 moves about tension rollers 112, 114. The rollers 112, 114 can be mounted in slots for selective linear adjustment to maintain a proper tension on the belt 106.

In a similar manner, the drive belt 108 is extended from the drive pulley 104, around a tension roller 116 to a drive extension 22*a* of the wheel 22. Accordingly, rotation of the drive pulley 104 due to operation of the drive motor 102 causes rotation of the wheel 22. The tension roller 116 is also mounted in a slot for selective linear adjustment to maintain a proper tension on the belt 108.

Figure 5:
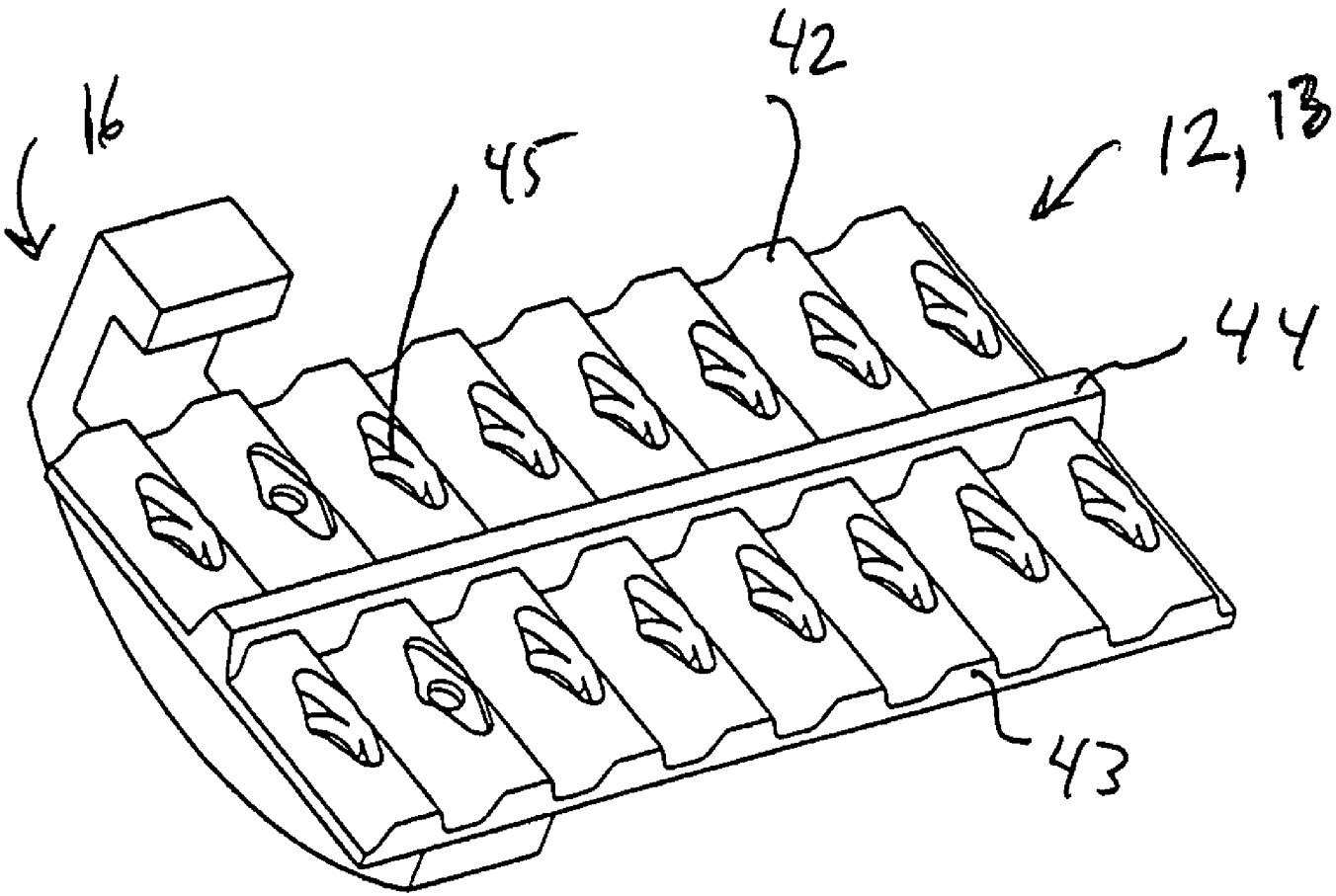
FIG. 5 shows a toothed side of a timing belt used in the conveyor of FIG. 4.

Referring now to FIGS. 5-8, there is illustrated features of the timing belts 12, 13 of this exemplary embodiment of the present invention. FIG. 5 shows a bottom side of the timing belt 12, 13. A toothed side 42 forms the bottom of the belt 12, 13. The toothed side 42 comprises a plurality of teeth 43 formed on either side of a centering ridge 44. The centering ridge 44 cooperates with the pulleys 14, 14*a,* 18, 18*a,* 34, 34*a,* 36, 36*a,* respectively, to maintain the belts 12, 13 in a proper alignment along the path defined by the saddle-back conveyor 10. Each of the teeth 43 is formed to include a threaded insert cavity 45 for use in mounting the pushing elements 16, as will appear.

Figure 6:
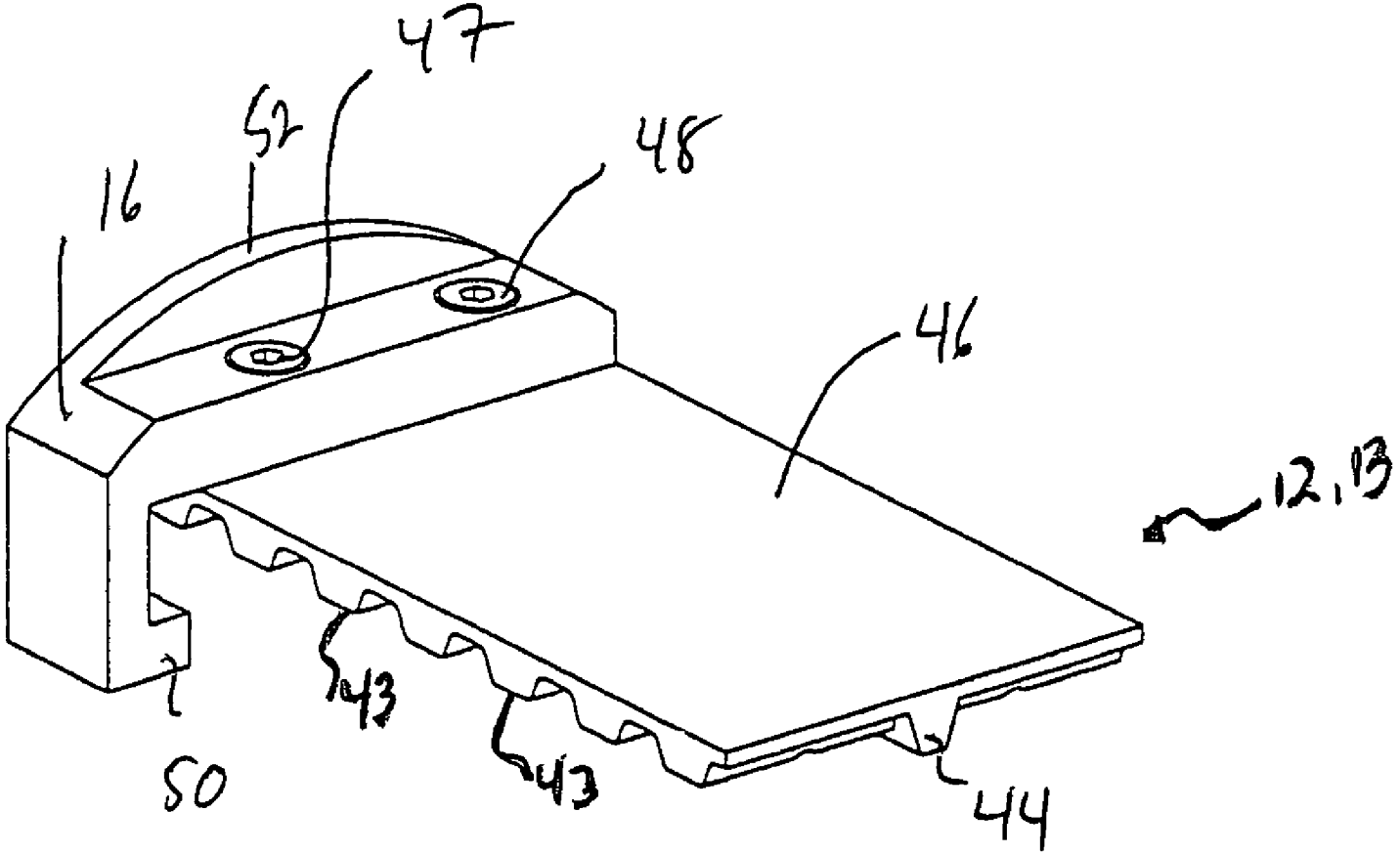
FIG. 6 shows a perspective view of the timing belt of FIG. 5.
Figure 8:
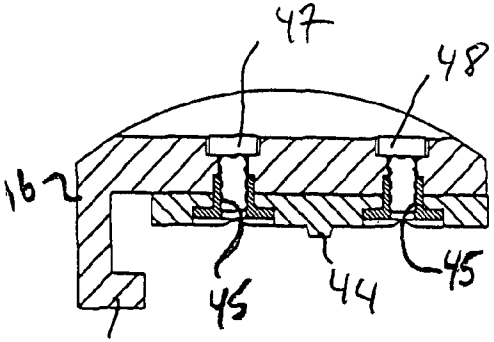
FIG. 8 shows a cross-sectional view of the timing belt, taken along line C-C of FIG. 7.
Figure 7:
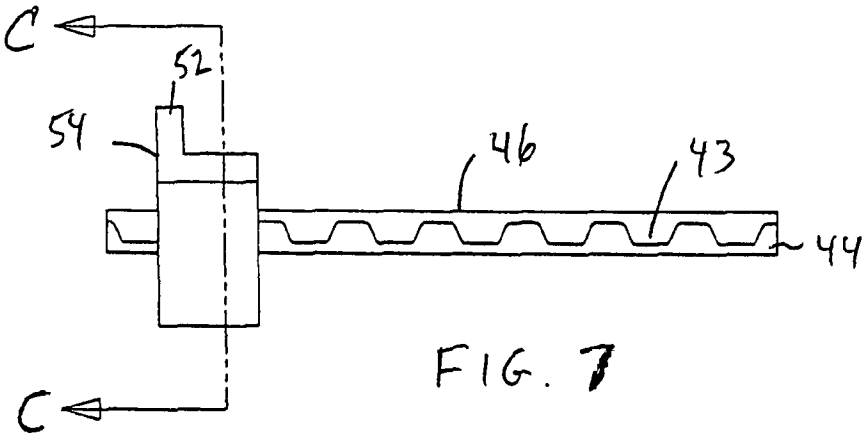
FIG. 7 shows a side view of the timing belt of FIG. 5.

As shown in FIG. 6, allen screws 47, 48 can be used to secure each pushing element 16 to the belt 12, 13 via threaded engagement with a corresponding threaded insert cavity 45 (see FIG. 8). A top side 46 of the belts 12, 13 comprises, for example, a 0.2 mm thick layer of polyurethane. The side 46 is pierced by the allen screws 47, 48 when they are inserted into the cavities 45. The locations of the pushing elements 16 along the length of the belts 12, 13, and the spacing between pushing elements 16 can be controlled and adjusted by selection of particular insert cavities 45 for use to attach the pushing elements 16.

According to a feature of the present invention, each pushing element 16 comprises a plastic material shaped to include a self-tracking guide 50, a curved outer surface 52, and a pushing surface 54 (see FIG. 7) for engagement with books 24. The self-tracking guide 50 is used to orient the respective pushing element 16, and the corresponding belt 12, 13, as the pushing element 16 passes along the wedge anvil 30, as will be described below.

Figure 9:
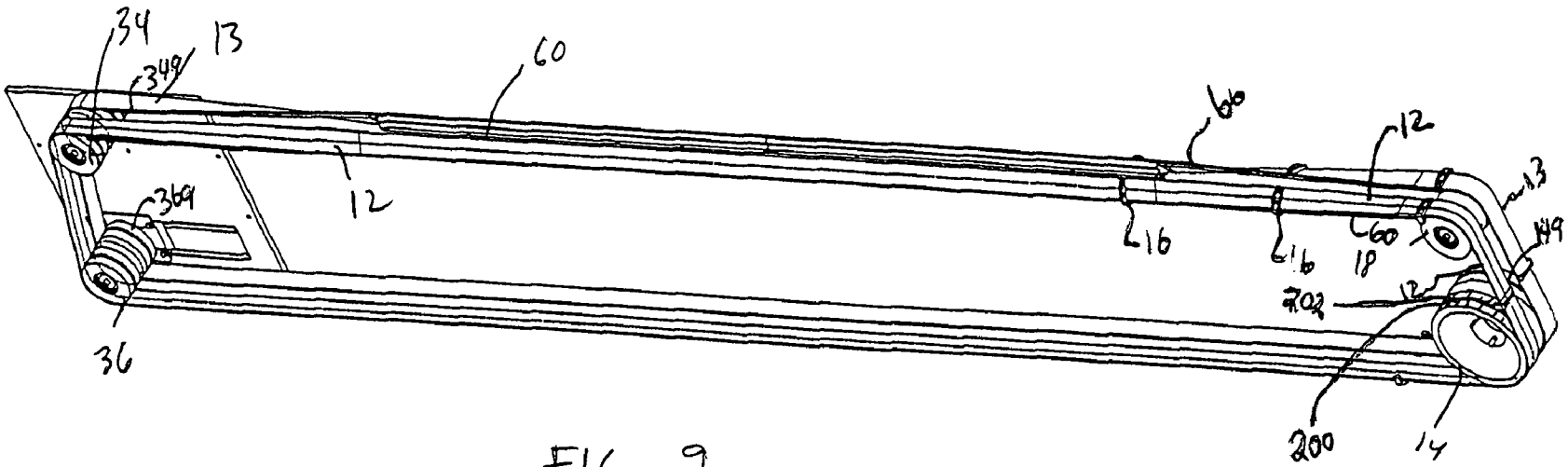
FIG. 9 illustrates certain parts of the conveyor of FIG. 4.

FIG. 9 shows details of the conveyor arrangement according to an exemplary embodiment of the present invention relevant to the example of the pushing element 16 illustrated in FIGS. 5-8. For example, the drive pulleys 14, 14*a* are provided with teeth 200 arranged to mesh with the teeth 43 of the bottom sides 42 of the belts 12, 13 for an efficient driving relation between the drive motor 102 and the belts 12, 13. Moreover, the drive pulleys 14, 14*a* are each formed to include a central groove 202 designed to receive the centering ridge 44 of the corresponding belt 12, 13 for centering of the belts 12, 13.

A pair of slider elements 60 is mounted adjacent the wedge anvil 30, one at either side thereof, to cooperate with the self-tracking guides 50 of the pushing elements 16, to orient the belts 12, 13. The slider elements 60 are arranged to bend from a horizontal orientation, upstream of the wedge anvil 30, when a corresponding self-tracking guide 50 first engages a respective slider element 60, to an angled orientation while adjacent to the wedge anvil 30, and back to a horizontal orientation downstream from the wedge anvil 30.

Figure 10:
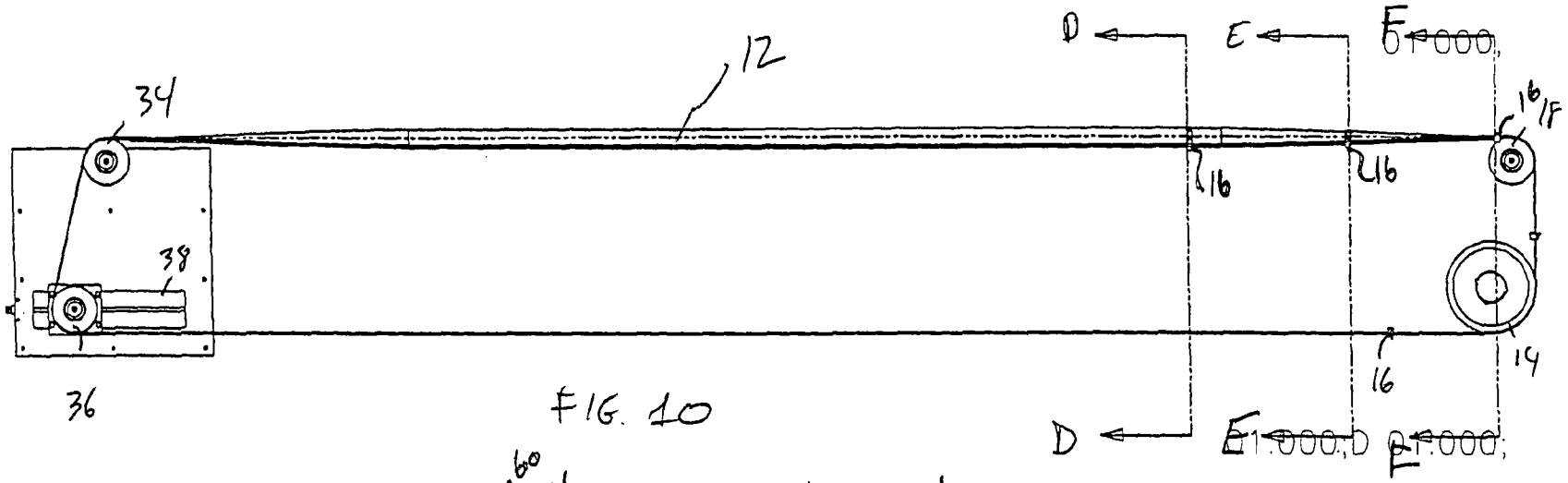
FIG. 10 shows a side view of a timing belt of the stitching device of FIG. 1, according to an exemplary embodiment of the present invention.
Figure 14:
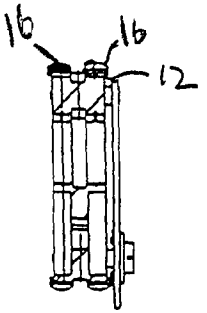
FIG. 14 is a cross-sectional view taken along line F-F of FIG. 10.
Figure 13:
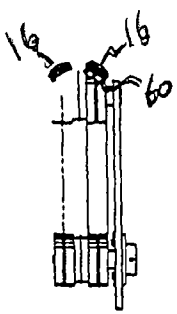
FIG. 13 is a cross-sectional view taken along line E-E of FIG. 10.
Figure 12:
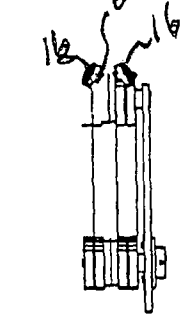
FIG. 12 is a cross-sectional view taken along line D-D of FIG. 10.
Figure 11:
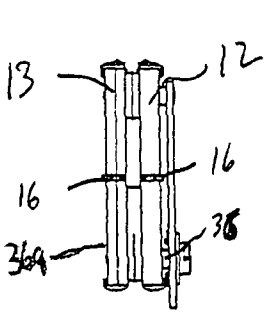
FIG. 11 shows an end view of the timing belt of FIG. 10.

FIGS. 10-14 illustrate the bending structure of the slider elements 60. In FIG. 10, the belt 12 is clearly shown as bending from a horizontal orientation at the F-F location, to a first angled orientation at the E-E location, to a fully angled orientation at the D-D location. The bending of the belts 12 is caused by the engagement between the guides 50 of the pushing elements 16 and the bending slider element 60. In FIG. 11, there is shown an end view of the conveyor 10, downstream of the wedge anvil 30. The belts 12, 13 move from horizontal to vertical as they turn around the pulleys 34, 34*a,* 36, 36*a*. Viewing the belts 12, 13, upstream from the end view of FIG. 11, at the location D-D of FIG. 10, in FIG. 12, it can be seen that the pushing elements 16 are engaged by the slider elements 60, and oriented at an angle due to the angled orientation of the corresponding slider element 60. The views illustrated in FIGS. 13 and 14, corresponding the E-E and F-F locations of FIG. 10 respectively, show the gradual reorientation of the pushing elements 16 to a horizontal position due to the bending of the corresponding slider elements 60.

Figure 15:
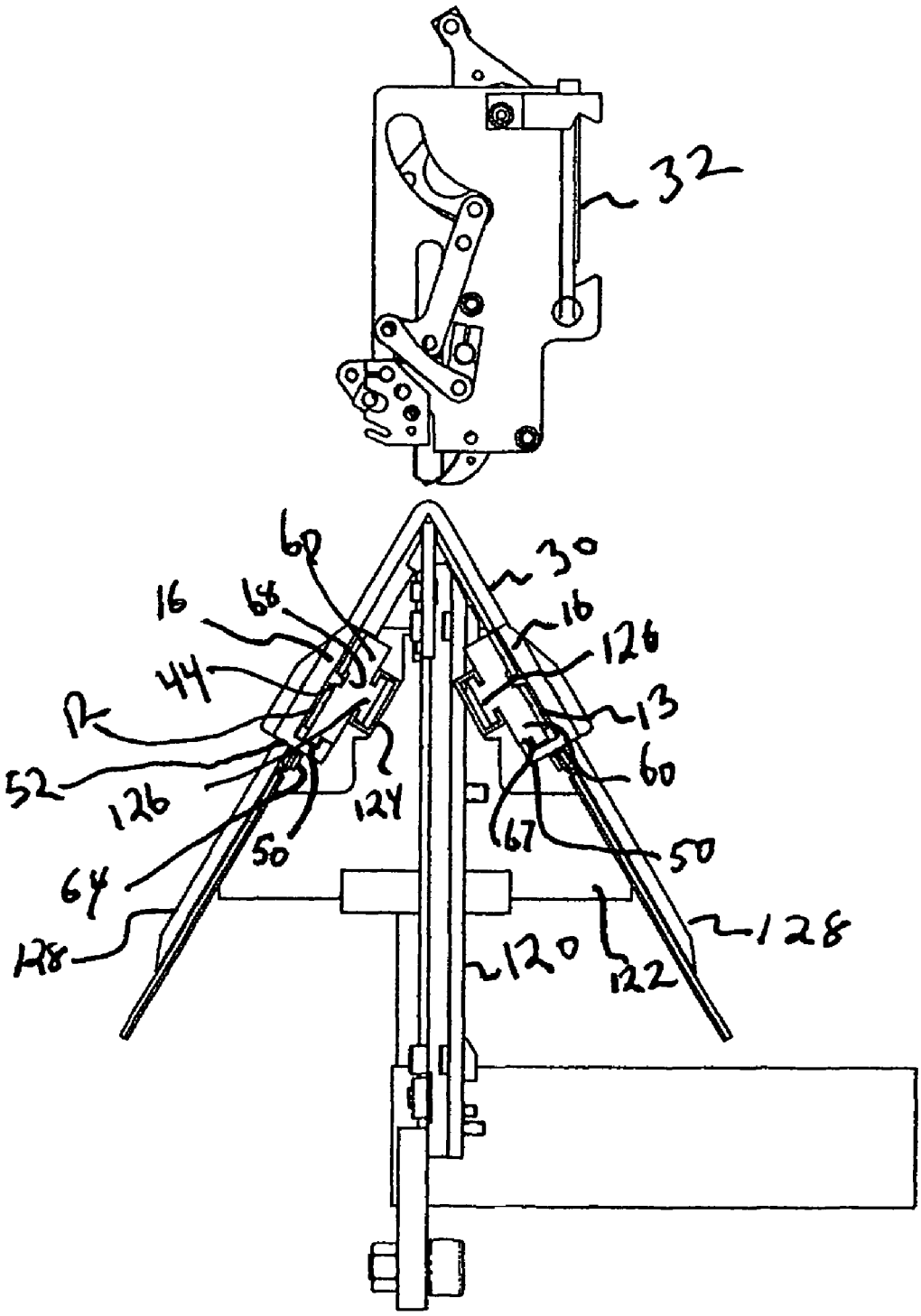
FIG. 15 is a side cross-sectional view of a detail of the conveyor used in the stitcher of FIG. 1, in a region of the conveyor adjacent a stitcher device.

FIG. 15 shows a side cross-sectional view of details of the exemplary saddle-back conveyor 10 according to the present invention. As shown, the wedge anvil 30 comprises a V-shaped element arranged to accommodate a book 24. A central support shaft 120 mounts each of the wedge anvil 30 and a support structure 122. The support structure 122, in turn, mounts the slider elements 60 by a pair of groove structures 124, each arranged to receive a T-shaped extension 126 of a corresponding one of the slider elements 60, for support of the slider elements 60, each at an angular orientation, adjacent and below the wedge anvil 30, at either side thereof, as clearly illustrated in FIG. 15.

Each of the slider elements 60 can be formed to include a slit 68, to receive the centering ridge 44 of the corresponding belt 12, 13. A stepped edge 67 is also formed on each of the slider elements 60 to cooperate and engage with the tracking guides 50 of the pushing elements 16, as described above. In addition, a guide 64 can be arranged to engage the surfaces 52 of the pushing elements 16 to further stabilize the belts 12, 13 as they move along the length of the wedge anvil 30, and to prevent separation of the pushing elements 16 from the respective slider element 60.

A pair of support panels 128 is mounted by the support structure 122, one on each side thereof, for further support of and guides for the books 24 being moved along the length of the conveyor 10.

Pursuant to a feature of the present invention, the spacing between the belts 12, 13 form a V-shaped open space to accommodate the anvil 30, and provide a stitching area for access by the stitcher 32, as clearly illustrated in FIG. 15.

FIGS. 16 and 17 show schematic representations of additional embodiments for the timing belts 12, 13 of the present invention. In FIG. 16, the belts 70 (12', 13') are mounted in an angled orientation, and a chain inserter 72 delivers the books 24 to the belts 70. In FIG. 17, the belts 88 run horizontally, and pusher attachments 86 are mounted in an angled orientation by the belts 88. A set of pulleys 84 is provided to mount and move the belts 88. A chain inserter 82 delivers the books 24 to the belts 88. In both embodiments sheet guides 89 may be provided.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A stitching device, comprising:

a stitcher; and a saddle-back conveyor for moving unstitched printed products past the stitcher for stitching, the saddle-back conveyor including:

a stationary wedge anvil forming a path past the stitcher for support of the unstitched printed products;

a timing belt having a plurality of pushing elements for engaging and moving the unstitched printed products past the stitcher along the wedge anvil; and a slider element arranged adjacent to the stationary wedge anvil to engage the timing belt;

wherein each of the plurality of pushing elements includes a self-tracking guide which engages with the slider element.

2. The stitching device of claim 1 wherein the timing belt comprises a plastic material.

3. The stitching device of claim 2 wherein the plastic comprises polyurethane.

4. The stitching device of claim 1 wherein the timing belt comprises a toothed timing belt.

5. The stitching device of claim 1 wherein each of the plurality of pushing elements is selectively adjustably mounted on the timing belt.

6. A stitching device, comprising:

a stitcher; and a saddle-back conveyor for moving unstitched printed products past the stitcher for stitching, the saddle-back conveyor comprising:

a stationary wedge anvil forming a path past the stitcher for support of the unstitched printed products; and a pair of timing belts, each timing belt having a plurality of pushing elements for engaging and moving the unstitched printed products past the stitcher along the wedge anvil; and slider elements arranged adjacent to the stationary wedge anvil to engage the timing belts;

wherein each of the plurality of pushing elements includes a self-tracking guide which engages the slider elements.

7. The stitching device of claim 6 wherein the pair of timing belts are spaced from one another to provide a space there between for access by the stitcher.

8. The stitching device of claim 6 wherein at least one of the timing belts comprises a plastic material.

9. The stitching device of claim 8 wherein the plastic comprises polyurethane.

10. The stitching device of claim 6 wherein at least one of the timing belts comprises a toothed timing belt.

11. The stitching device of claim 6 wherein each of the plurality of pushing elements is selectively adjustably mounted on the corresponding timing belt.

12. A method for stitching unbound printed products, comprising the steps of:

providing a stitcher;

transporting unstitched printed products on a saddle conveyor past the stitcher along a stationary wedge anvil for stitching using pushing elements attached to a timing belt;

engaging the unstitched printed products with the pushing elements; and reorienting the pushing elements at an angle that corresponds to an angle of the stationary wedge anvil as the pushing elements transporting unstitched printed products along the stationary wedge anvil.

13. A stitching device, comprising:

a stitcher; and a saddle-back conveyor for moving unstitched printed products past the stitcher for stitching, the saddle-back conveyor including:

a stationary wedge anvil forming a path past the stitcher for support of the unstitched printed products;

a timing belt having a plurality of pushing elements for engaging and moving the unstitched printed products past the stitcher along the wedge anvil; and a slider element for angling the timing belt as the pushing elements move the unstitched printed products past the stitcher;

each of the plurality of pushing elements including a self-tracking guide which engages with the slider element.

14. The stitching device of claim 13 wherein the timing belt comprises a plastic material.

15. The stitching device of claim 14 wherein the plastic comprises polyurethane.

16. The stitching device of claim 13 wherein the timing belt comprises a toothed timing belt.

17. The stitching device of claim 13 wherein each of the plurality of pushing elements is selectively adjustably mounted on the timing belt.

18. A stitching device, comprising:

a stitcher; and a saddle-back conveyor for moving unstitched printed products past the stitcher for stitching, the saddle-back conveyor comprising:

a stationary wedge anvil forming a path past the stitcher for support of the unstitched printed products;

a first timing belt and a second timing belt, each timing belt having a plurality of pushing elements for engaging and moving the unstitched printed products past the stitcher along the wedge anvil;

a first slider element for angling the first timing belt as the first timing belt moves the unstitched printed products past the stitcher; and a second slider element for angling the second timing belt as the second timing belt moves the unstitched printed products past the stitcher;

each of the plurality of pushing elements including a self-tracking guide which engages one of the slider elements.

19. The stitching device of claim 18 wherein the first or second timing belt comprises a plastic material.

20. The stitching device of claim 19 wherein the plastic comprises polyurethane.

21. The stitching device of claim 18 wherein the first or second timing belt comprises a toothed timing belt.

22. The stitching device of claim 18 wherein each of the plurality of pushing elements is selectively adjustably mounted on the first or second timing belt.

23. The stitching device of claim 18 wherein the first and second timing belts are spaced from one another to provide a space there between for access by the stitcher.

* * * * *